US006792931B1

(12) United States Patent
Schaar

(10) Patent No.: US 6,792,931 B1
(45) Date of Patent: Sep. 21, 2004

(54) MEANS OF INCREASING MECHANICAL ADVANTAGE IN ASYNCHRONOUS COMPOUND BOWS

(76) Inventor: John G. Schaar, 1048 W. Greenway Dr., Tempe, AR (US) 85282

( * ) Notice: Subject to any disclaimer, the term of this patent is extended or adjusted under 35 U.S.C. 154(b) by 0 days.

(21) Appl. No.: 10/705,712

(22) Filed: Nov. 12, 2003

(51) Int. Cl.[7] ..... F41B 5/10
(52) U.S. Cl. ..... 124/25.6
(58) Field of Search ..... 124/23.1, 25.6, 124/86, 88, 900

(56) References Cited

U.S. PATENT DOCUMENTS 4,287,867 A * 9/1981 Islas ..... 124/25.6
4,649,890 A * 3/1987 Powers ..... 124/25.6
4,858,588 A * 8/1989 Bozek ..... 124/23.1
5,024,206 A * 6/1991 Lester ..... 124/23.1
5,979,425 A * 11/1999 Loomis ..... 124/25.6
6,029,644 A * 2/2000 Bronnert ..... 124/25.6
6,055,974 A * 5/2000 Dieziger ..... 124/23.1
6,067,974 A * 5/2000 Islas ..... 124/25.6

* cited by examiner

*Primary Examiner*—John A. Ricci

(57) ABSTRACT

The invention defines alternate means of increasing mechanical advantage in asynchronous compound bows of a type generally defined in U.S. Pat. No. 6,470,870, which employ dual planar compound pulleys as the primary leverage inducing agent, and at least one non-coplanar actuator section rigging. Additional pulley elements are added to the primary limb, or PRES member extension, or both, in a variety of possible configurations, in a manner that provides greater leverage than would be present in prior art asynchronous compound bows of the type defined generally by U.S. Pat. No. 6,470,870.

4 Claims, 5 Drawing Sheets

Asynchronous Compound Bow

MEANS OF INCREASING MECHANICAL ADVANTAGE IN ASYNCHRONOUS COMPOUND BOWS

PRIOR ART REFERENCES

Nov. 29, 2002 Schaar U.S. Pat. No. 6,470,870.

BACKGROUND OF THE INVENTION

This invention relates to asynchronous compound bows of the type generally defined by U.S. Pat. No. 6,470,870, and the teachings and prior art reference citations of that patent are intended to be incorporated in this application by reference.

U.S. Pat. No. 6,470,870 successfully addressed an entire performance-engineering matrix of 96 potential problems inherent in compound bows of the bi-synchronous genre'. This invention seeks to expand on the new asynchronous configuration defined in U.S. Pat. No. 6,470,870 by providing one or more means of further increasing mechanical advantage in bows whose primary leveraging components are configured generally in a manner defined by that invention.

Further increasing mechanical advantage in asynchronous compound bow systems provides benefits beyond those inherent in bows as defined by U.S. Pat. No. 6,470,870 by making it possible for archers to bend bows with stiffer primary limbs than would be possible with the same amount of effort using asynchronous compound bows as specifically defined in U.S. Pat. No. 6,470,870.

The scope of this application is limited to providing that additional measure of usefulness to persons electing to use asynchronous compound bows having dual-planar leverage inducing pulleys, a Pulley Return Energy Storage member or extension, and at least one actuator segment that is not planar with the longitudinal centerline of the bows primary limbs, i.e. asynchronous compound bows as generally described in U.S. Pat. No. 6,470,870.

It should be noted that some configurations shown in the drawings for this invention are similar to prior art approaches used in the early days of commercially viable compound bows. The early "four wheeler" compounds utilized additional simple pulley elements attached to the primary limbs, but in a bi-synchronous configuration, wherein the actuator segments extended from a pulley at one end of the bow, past the horizontal centerline of the bow, to a point where they rolled over a simple pulley attached to the limb at the other end of the bow, and then terminated at a "pylon" that was also attached to opposite end of the riser from the pulley to which the actuator was attached.

All of the configurations shown in this invention achieve the same end result as the "four wheelers" common to the early days of compound bows (circa 1970), but most importantly do so in an asynchronous configuration where the actuators do NOT extend past the horizontal centerline of the bow. Because the pulleys and actuators are deployed in an asynchronous configuration, all of the potential 64 problem areas associated with bi-synchronous compound bows are avoided.

In essence this invention seeks to demonstrate that past inventors went "a bridge too far" when deploying the extra pulleys in an essentially bi-synchronous configuration. By taking the route they did, bi-synchronous compound bow designers inadvertently accepted all 64 of the unavoidable conflicts that have been shown to be associated with compound bows of the bi-synchronous type.

DESCRIPTION OF THE DRAWINGS

In each drawing, for purposes of simplification, only one end of the asynchronous compound bow rigging is shown, It is understood that the opposite end of the bow is similarly configured.

DESCRIPTION OF THE PREFERRED EMB DIMENT(S)

Figure 1:
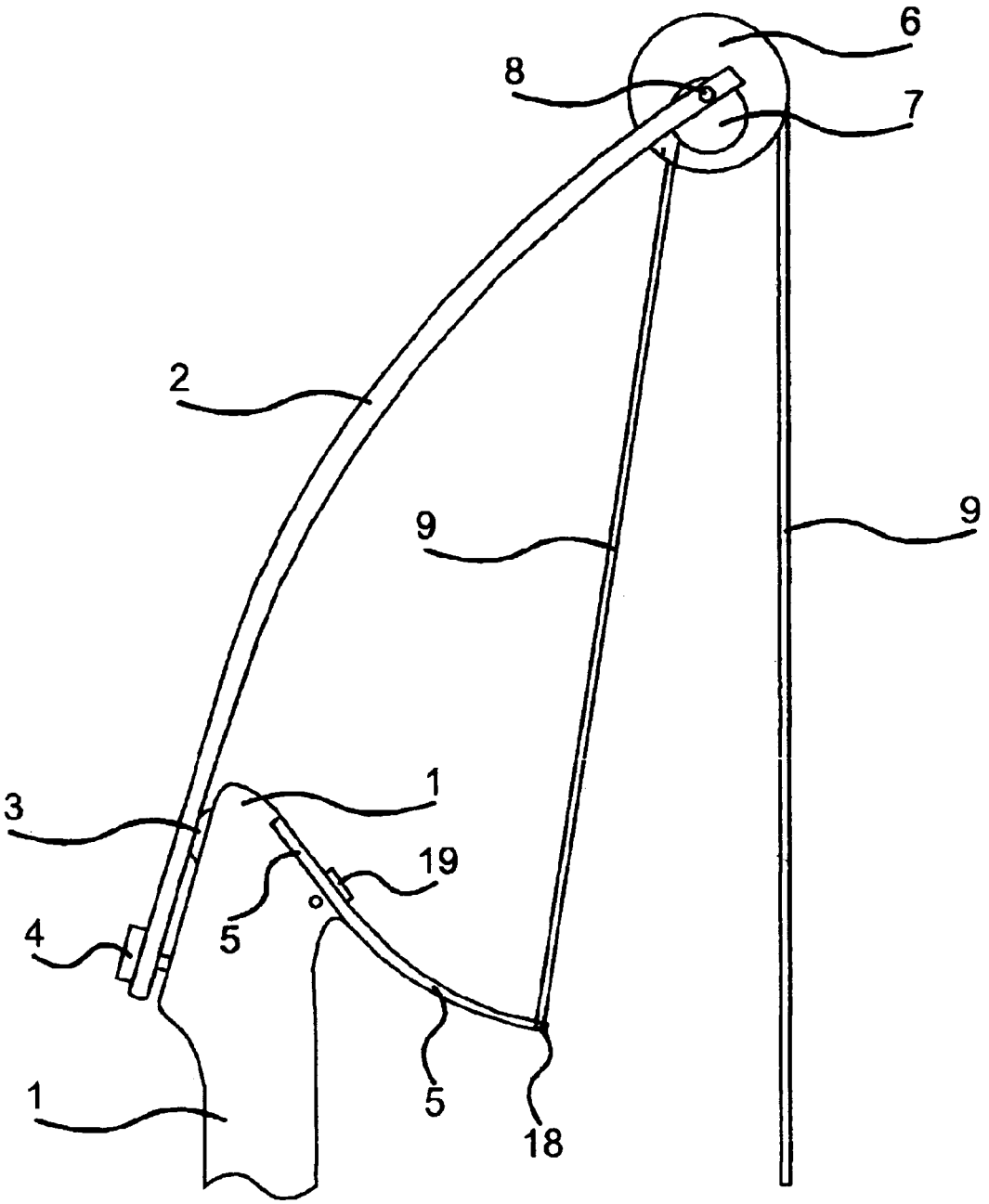
FIG. 1 Prior Art
FIG. 1 is a view of the prior art showing the termination of the actuator at a point near the end of the PRES member after coming off of the secondary side of the pulley in a compound bow having an asynchronous configuration that includes a dual planar compound pulley and at least one actuator segment that is not co-planar with the vertical centerline of the bows limbs.

The purpose of this invention is to define means of increasing mechanical advantage in the pulley-actuator system that may be used to bend stiffer primary limbs with the same amount of tension applied to the system by the archer drawing the bow, than would be possible in prior art asynchronous compound bows. Four variations on a theme incorporating additional pulleys mounted at the same end of the bow where the primary leverage-inducing pulley is mounted are shown in FIGS. 2 through 5. Each of the configurations shown in FIGS. 2 through 5 will result in increasing mechanical advantage in the pulley-actuator system when compared to the prior art. The more pulleys added, the greater will be the increase in mechanical advantage to the overall system. Since the desired degree is increase in mechanical advantage is a subjective calculation by the bow designer, none of the figures (2 through 5) can be said to truly represent a "preferred" embodiment. Any one of these figures might be considered to represent a "preferred embodiment" of the invention, depending on the goals of the person using the teachings herein.

It should be noted that each of the embodiments shown in FIGS. 2 through 5 bring additional mechanical advantage to the system at some cost of increasing overall friction in the pulley-actuator system. It will necessarily be the objective of those using the teachings of this invention to determine the precise points where the advantages of increased mechanical advantage in the system outweigh the disadvantages of increased friction inherent in the number of pulleys employed.

As a means of assisting those familiar with the art of compound bows in understanding the benefits of this invention, and understanding how one might go about constructing bows using the teaching of this invention, I will first review the general construction elements of asynchronous compound bows of the type upon which this invention seeks to build.

Asynchronous compound bows are differentiated from bi-synchronous compound bows by the way the actuators and leveraging components are configured. In bi-synchronous compound bows, the actuators exit a pulley on one end of the bow and are terminated at a point somewhere on the other end of the bow. The actuators in bi-synchronous compound bows thus are forced to "cross over" the horizontal midpoint of the bow. The actuator (cable) "cross over" feature in bi-synchronous compound bows creates a number of undesirable conditions that have to be mitigated if the bow is to function acceptably.

Asynchronous compound bows have pulley/actuator configurations that provide for the actuators exiting the pulleys at each of the bow's ends, to each be terminated (tied off) at a point somewhere at the same end of the bow, without ever first "crossing over" the horizontal centerline of the bow. Asynchronous compound bows thus avoid the conflicts caused by cables (actuators) having to "cross over" the horizontal centerline of the bow.

Prior art U.S. Pat. No. 6,470,870 defined a generic asynchronous compound configuration that employed dual planar pulleys, a component at each end of the bow for accepting the actuator termination (Pulley Return Energy Storage component or PRES component for short), wherein at least one of the actuator segments was purposely positioned to not be in the same plane as the vertical centerline of the bows limbs, and wherein the actuator at each end of the bow was terminated on a PRES component at the same end of the bow. Although in U.S. Pat. No. 6,470,870 no actuator segment lay in a plane coincident with the vertical centerline of the bows limbs, the overall rigging nonetheless yielded a resultant force vector that did lie in a plane generally coincident with the vertical centerline of the bows limbs.

FIG. 1 displays a side view of one end of a prior art asynchronous compound bow rigging as defined in U.S. Pat. No. 6,470,870. The riser element (1) has attached to it a primary limb (2), operating over fulcrum (3), and held in place by adjusting bolt (4). On the opposite side of the riser component a PRES member (5) is attached by Bolt and pin (19). This PRES configuration is for illustration purposes only. The PRES member may be resilient (flexing), or substantially rigid. The PRES member may be an integral extension of the Riser, an integral extension of the primary bow limb, or be mechanically connected to either. At the far end of the primary limb a compound pulley having a larger (primary) side (6) and smaller (secondary) side (7) is attached by way of an axle assembly (8) that passes through the pulley. The end of the bow limb is notched to accept the pulley between its sides. The bowstring/actuator (9) engages the groove provided for that purpose in the large side of the pulley, passing around it's circumference, then passes laterally through the pulley and engages the secondary pulley, exiting it's groove and proceeding to a point where it terminates (18) on the PRES element at the same end of the bow. As the bow string is pulled, actuator material unrolls from around the primary side of the pulley, and actuator material is rolled up in the pulley groove in the secondary side of the pulley, exerting leverage as it bends against the resisting force of the PRES. When the string is released these forces are reversed and the arrow is propelled forward from the bow.

Figure 2:
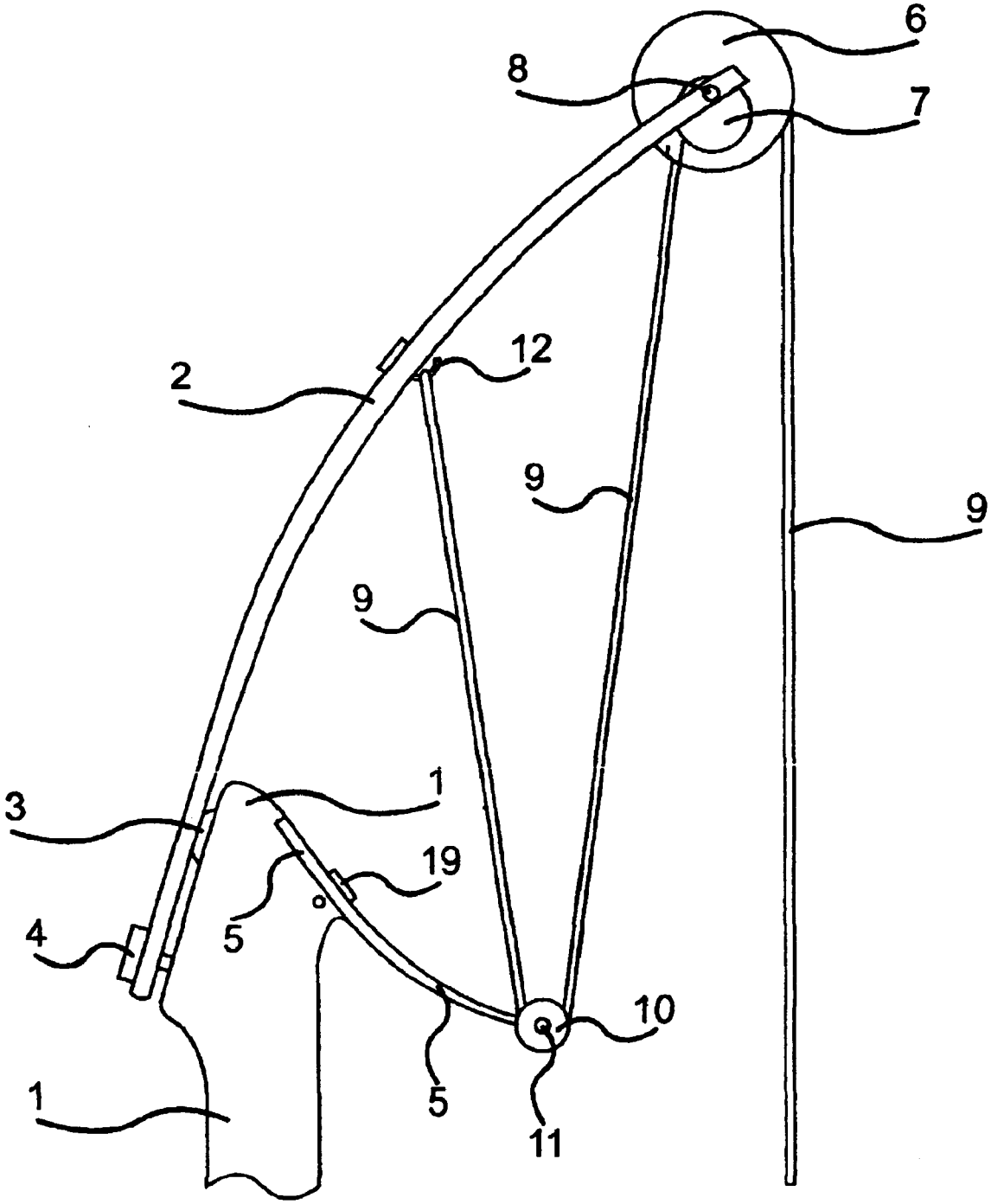
FIG. 2 is a view of a means of increasing mechanical advantage (leverage) in the pulley/actuator system in a compound bow having an asynchronous configuration that includes a dual planar compound pulley and at least one actuator segment that is not co-planar with the vertical centerline of the bows limbs, by adding a simple pulley to the PRES component(s)s, and thereafter terminating the actuator at a point intermediate the ends of the primary limb at the same end of the bow after engaging the simple pulley attached to the PRES, with the affected PRES also being located at the same end of the bow.

FIG. 2 illustrates an asynchronous system wherein a single additional pulley (10) is incorporated near the endpoint of a PRES member, rotating around an intermediate pulley-axle centerpoint (11). The intermediate pulley (10) is grooved to accept an actuator segment (9). The actuator segment (9) is extended so as to engage the grooves in the pulley (10) and continue on to a point of termination (12) at a point intermediate the ends of the primary limb (2). Typically both the intermediate pulley and the termination point on the primary limb member will be aligned with the vertical centerline of the primary limb, although this is not a requirement of the invention. An advantage of this configuration is that the tieoff point being intermediate the ends of the primary limb causes bending leverage to be applied at multiple points along the surface of the limb, and may serve to both distribute bending forces more optimally, and to dampen vibrations in the intermediate section of the primary limb when the bowstring is released.

Figure 3:
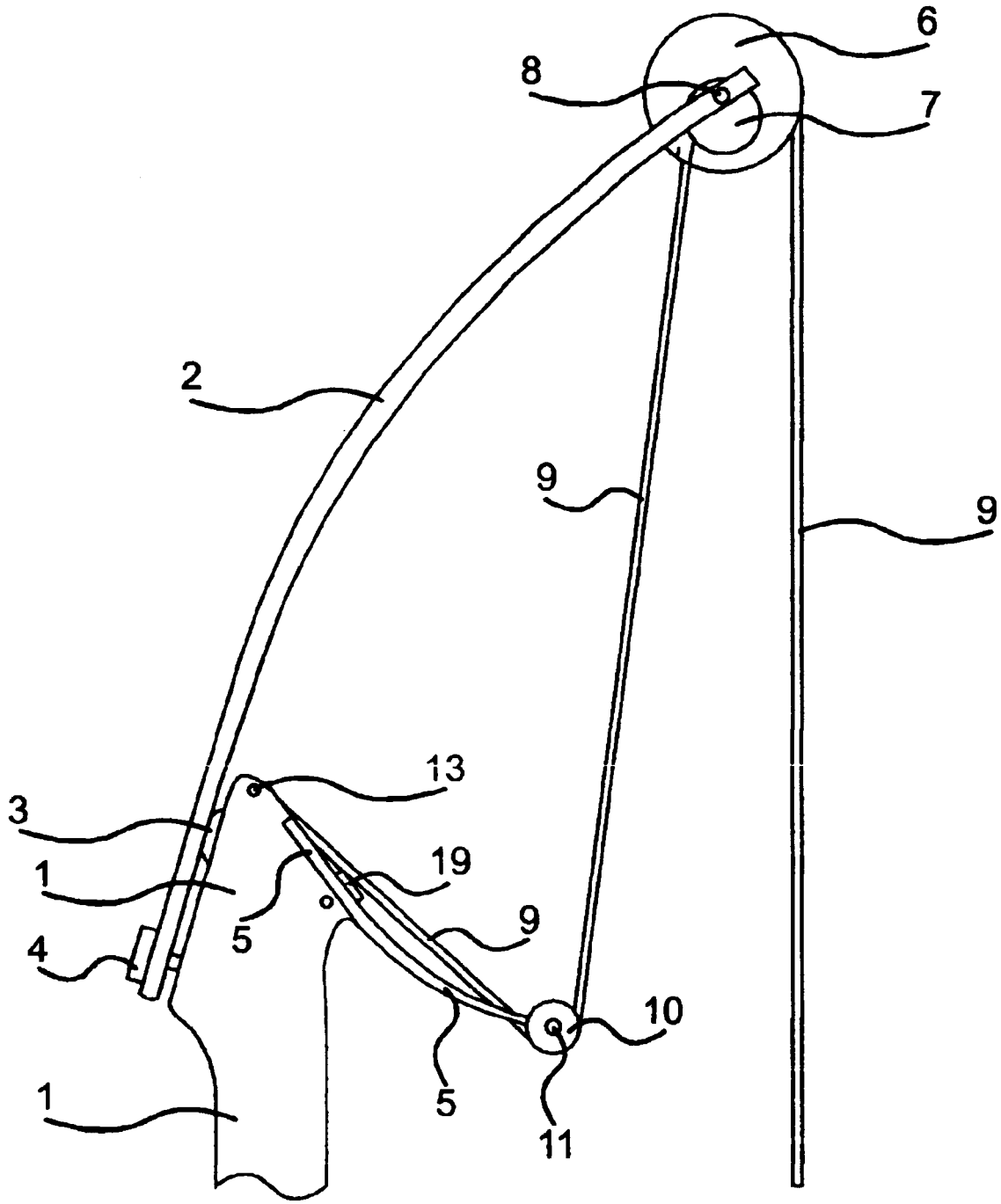
FIG. 3 is another view of a means of increasing mechanical advantage in the pulley/actuator system in a compound bow having an asynchronous configuration that includes a dual planar compound pulley and at least some actuator segments that are not co-planar with the vertical centerline of the bows limbs, by adding a simple pulley to the PRES component(s), and thereafter terminating the actuator at a point on the riser component, at the same end of the bow after engaging the simple pulley attached to the PRES, with the affected PRES also being located at the same end of the bow.

FIG. 3 illustrates an asynchronous system wherein a single additional pulley (10) is incorporated near the endpoint of a PRES member, rotating around intermediate pulley-axle centerpoint (11). The intermediate pulley (10) is grooved to accept an actuator segment (9). The actuator segment (9) is extended so as to engage the grooves in the pulley (10) and continue on to a point of termination (13) at a point on the riser component of the bow (1). Typically both the intermediate pulley and the termination point on the riser component will be aligned with the vertical centerline of the primary limb, although this is not a requirement of the invention. An advantage of this configuration is that the tieoff point is in very close proximity to the intermediate pulley, and weights of materials in the extended actuator segment will be less in any given material type than they would be in bows configured as in FIG. 2. Additionally the swing weight of the primary limbs will be a bit less; due to not having to incorporate an actuator tieoff means intermediate the ends of the primary limbs.

Figure 4:
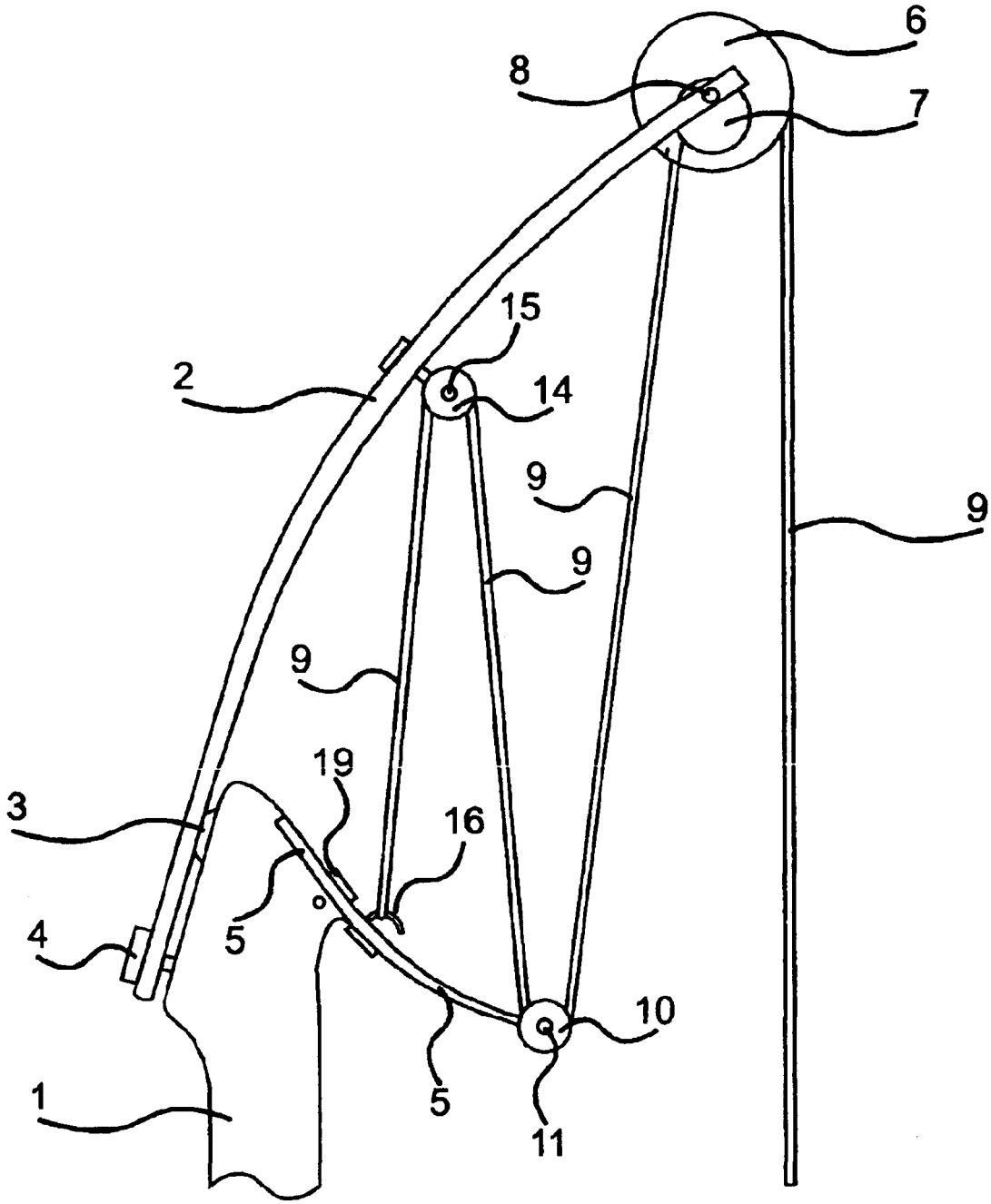
FIG. 4 is another view of a means of increasing mechanical advantage in the pulley/actuator system in a compound bow having an asynchronous configuration that includes a dual planar compound pulley and at least one actuator segment that is not co-planar with the vertical centerline of the bows limbs, by adding a simple pulley to the PRES component(s), as was shown in FIGS. 2 and 3, and still another simple pulley attached to the primary limb at a point intermediate it's ends, and thereafter terminating the actuator, after engaging both of these simple intermediate pulleys, at an intermediate point along the length of the PRES, with all affected components being located at the same end of the bow.

FIG. 4 illustrates an asynchronous configuration wherein an additional intermediate pulley (14) is attached to the primary limb (2) in addition to having an intermediate pulley (10) incorporated near the end of the PRES member (5) at the same end of the bow as is the primary limb (2). The intermediate pulley (14) is grooved to accept and engage the extended actuator (9), and rotates around an axle (15) incorporated in a terminal attached to the primary limb (2) at a point intermediate its ends. The extended actuator (9) is configured to engage both the intermediate pulley incorporated in the PRES component (10), and the additional intermediate pulley (14) attached at the intermediate point along the length of the primary limb, and to thereafter extend to and be terminated at a point (16) intermediate the ends of the PRES extension at the same end of the bow. Typically both intermediate pulleys (10 and 14) and the termination point on the PRES extension (16) will be configured to lie in the same plane as the centerline of the bows primary limbs, but this is not a requirement of the invention. Advantages of this approach include additional mechanical advantage incorporated in the overall pulley-actuator system, additional bending forces being applied to both the primary limb and PRES extension at points, intermediate their ends, and additional vibration damping in both flexing members.

Figure 5:
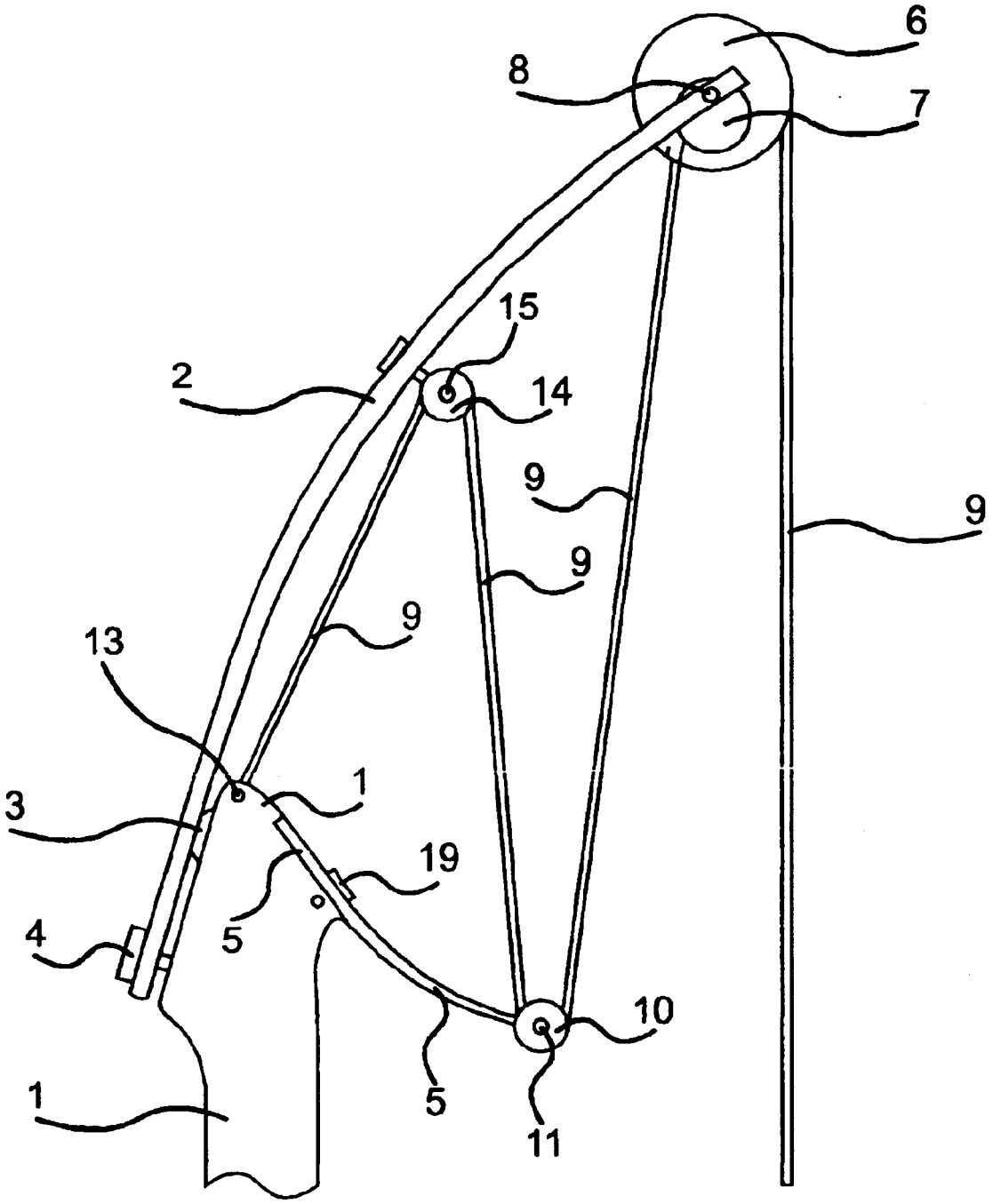
FIG. 5 is another view of a means of increasing mechanical advantage in the pulley/actuator system in a compound bow having an asynchronous configuration that includes a dual planar compound pulley and at least one actuator segment that is not co-planar with the vertical centerline of the bows limbs, by adding a simple pulley to the PRES component(s), as was shown in FIGS. 2 and 3, and still another simple pulley attached to the primary limb at a point intermediate it's ends, as shown in FIG. 4, and thereafter terminating the actuator, after engaging both of these simple intermediate pulleys, at a point on the riser component of the bow, with all affected components being located at the same end of the bow.

FIG. 5 illustrates an asynchronous configuration wherein an additional intermediate pulley (14) is attached to the primary limb (2) in addition to having an intermediate pulley (10) incorporated near the end of the PRES member (5) at the same end of the bow as is the primary limb (2). The intermediate pulley (14) is grooved to accept and engage the extended actuator (9), and rotates around an axle (15) incorporated in a terminal attachment affixed to the primary limb (2) at a point intermediate its ends. The extended actuator (9) is configured to engage both the intermediate pulley incorporated in the PRES component (10), and the additional intermediate pulley (14) attached at the intermediate point along the length of the primary limb, and to thereafter extend to and be terminated at a point (13) on the riser component. Typically both intermediate pulleys (10 and 14) and the termination point on the PRES extension (13) will be configured to lie in the same plane as the centerline of the bows primary limbs, but this is not a requirement of the invention. Advantages of this approach include additional mechanical advantage incorporated in the overall pulley-actuator system, additional bending forces being applied to the primary limb at points intermediate the limb ends, additional vibration damping to the primary limb upon release, and a shorter extended actuator length that has to be accelerated forward on release.

What is claimed is:

1. A compound bow having asynchronous primary limb and primary pulley-actuator operation, wherein no actuator segment, except the bowstring section used to draw the bow, extends past the vertical center of the bows riser segment, which asynchronous operation incorporates a minimum of one dual-planar primary leverage inducing pulley, and a pulley-return-energy-storage-source (PRES) incorporated in the bows overall configuration at (at) least one end of the bow, said bow incorporating in addition to the primary leverage inducing pulley mounted proximate the end of at least one of the bows primary limbs, a minimum of one additional simple intermediate pulley incorporated in the PRES extension located at the same end of the bow, which intermediate pulley engages an extended actuator length coming from the primary leverage inducing pulley, and which extended actuator length thereafter continues on to and is terminated at a point intermediate the ends of the primary limb mounted on the same end of the bows riser section that the primary pulley that the extended actuator length emanates from is mounted at.

2. A compound bow having asynchronous primary limb and primary pulley-actuator operation, wherein no actuator segment, except the bowstring section used to draw the bow, extends past the vertical center of the bows riser segment, which asynchronous operation incorporates a minimum of one dual-planar primary leverage inducing pulley, and a pulley-return-energy-storage-source (PRES) incorporated in the bows overall configuration at (at) least one end of the bow, said bow incorporating in addition to the primary leverage inducing pulley mounted proximate the end of at least one of the bows primary limbs, a minimum of one additional simple intermediate pulley incorporated in the PRES extension located at the same end of the bow, which intermediate pulley engages an extended actuator length coming from the primary leverage inducing pulley, and which extended actuator length thereafter continues on to and is terminated at a point on the bows riser section at the same end of the bows riser section that the primary pulley that the extended actuator length emanates from is mounted at.

3. A compound bow having asynchronous primary limb and primary pulley-actuator operation, wherein no actuator segment, except the bowstring section used to draw the bow, extends past the vertical center of the bows riser segment, which asynchronous operation incorporates a minimum of one dual-planar primary leverage inducing pulley, and a pulley-return-energy-storage-source (PRES) incorporated in the bows overall configuration at (at) least one end of the bow, said bow incorporating in addition to the primary leverage inducing pulley mounted proximate the end of the bows primary limb at the same end of the bow, a minimum of one additional simple intermediate pulley incorporated in the PRES extension located at the same end of the bow, which intermediate pulley engages an extended actuator length coming from the primary leverage inducing pulley, and which extended actuator length thereafter continues on to and engages a minimum of one more intermediate pulley that is fixed in place at a point intermediate the ends of the primary limb at the same end of the bow, and which extended actuator length then continues to a termination point intermediate the ends of the PRES extension located at the same end of the bow that the primary pulley that the extended actuator length emanates from is mounted at.

4. A compound bow having asynchronous primary limb and primary pulley-actuator operation, wherein no actuator segment, except the bowstring section used to draw the bow, extends past the vertical center of the bows riser segment, which asynchronous operation incorporates a minimum of one dual-planar primary leverage inducing pulley, and a pulley-return-energy-storage-source (PRES) incorporated in the bows overall configuration at (at) least one end of the bow, said bow incorporating in addition to the primary leverage inducing pulley mounted proximate the end of the bows primary limb at the same end of the bow, a minimum of one additional simple intermediate pulley incorporated in the PRES extension located at the same end of the bow, which intermediate pulley engages an extended actuator length coming from the primary leverage including pulley, and which extended actuator length thereafter on to and engages a minimum of one more intermediate pulley that is fixed in place at a point intermediate the ends of the primary limb at the same end of the bow, and which extended actuator length then continues to a termination point on the bows riser section, said termination point being located at the same end of the bow that the primary pulley that the extended actuator length emanates from is mounted at.

* * * * *